US009028284B2

(12) United States Patent
Lengert et al.

(10) Patent No.: US 9,028,284 B2
(45) Date of Patent: May 12, 2015

(54) CRIMPING SLEEVE FOR CRIMPED CONNECTIONS

(75) Inventors: Claude Lengert, Obernai (FR); Daniel Ackermann, Wittisheim (FR)

(73) Assignee: Stocko Contact GmbH & Co. KG, Wuppertal (DE)

( * ) Notice: Subject to any disclaimer, the term of this patent is extended or adjusted under 35 U.S.C. 154(b) by 220 days.

(21) Appl. No.: 13/811,251

(22) PCT Filed: Jul. 14, 2011

(86) PCT No.: PCT/EP2011/062033

§ 371 (c)(1),
(2), (4) Date: May 1, 2013

(87) PCT Pub. No.: WO2012/010488

PCT Pub. Date: Jan. 26, 2012

(65) Prior Publication Data

US 2013/0231012 A1 Sep. 5, 2013

(30) Foreign Application Priority Data

Jul. 19, 2010 (DE) ..... 10 2010 031 505

(51) Int. Cl.
*H01R 4/20* (2006.01)
*H01R 4/18* (2006.01)
(Continued)

(52) U.S. Cl.
CPC ..... *H01R 4/20* (2013.01); *H01R 4/184* (2013.01); *H01R 13/05* (2013.01); *H01R 43/16* (2013.01)

(58) Field of Classification Search
CPC ..... H01R 4/188; H01R 4/20; H01R 4/183; H01R 4/184
USPC ..... 439/877–882
See application file for complete search history.

(56) References Cited

U.S. PATENT DOCUMENTS 1,631,719 A 6/1927 Chandler
2,759,256 A 8/1956 Bergan
(Continued)

FOREIGN PATENT DOCUMENTS

JP 2004303526 A 10/2004

OTHER PUBLICATIONS

International Search Report, dated Apr. 10, 2011 (English) and German.
(Continued)

*Primary Examiner* — Gary Paumen
(74) *Attorney, Agent, or Firm* — International IP Law Group, PLLC

(57) ABSTRACT

The invention relates to a crimping sleeve comprising a base part and at least two deformable crimping blades for producing a crimped connection to a cable, wherein the crimping blades each comprise a first region connected to the base part, a second region, and a middle region disposed between the first and the second regions, and wherein the base part comprises a greater thickness than the middle region of the crimping blades, the first region tapers down from the base part toward the middle region at least on a first side and the second region further tapers down from the middle region, starting at least on a second side opposite the first side, said sleeve thereby being equally suitable for cables having different cross sections for producing a reliable connection between the cables and crimping sleeve. The invention further relates to a connecting element having such a crimping sleeve.

12 Claims, 4 Drawing Sheets

(51) Int. Cl.
*H01R 13/05* (2006.01)
*H01R 43/16* (2006.01)

(56) References Cited

U.S. PATENT DOCUMENTS

| | | | | |
|---|---|---|---|---|
| 2,930,113 | A | 3/1960 | Greco | |
| 4,082,402 | A * | 4/1978 | Kinkaid et al. | 439/422 |
| 5,396,033 | A * | 3/1995 | Piriz et al. | 174/94 R |
| 5,486,653 | A | 1/1996 | Dohi | |
| 8,123,575 | B2 * | 2/2012 | Ukai | 439/877 |
| 2004/0137802 | A1 * | 7/2004 | Wendling et al. | 439/877 |
| 2004/0227632 | A1 | 11/2004 | Grijalva et al. | |
| 2006/0068653 | A1 * | 3/2006 | Sakaguchi et al. | 439/877 |
| 2006/0202825 | A1 | 9/2006 | Rajapakse et al. | |

OTHER PUBLICATIONS

International Preliminary Report on Patentability, dated Jan. 22, 2013 (English translation).

* cited by examiner

CRIMPING SLEEVE FOR CRIMPED CONNECTIONS

CROSS REFERENCE TO RELATED APPLICATIONS

Pursuant to 35 U.S.C. §371, this application is the United States National Stage Application of International Patent Application No. PCT/EP2011/062033, filed on Jul. 14, 2011, the contents of which are incorporated by reference as if set forth in their entirety herein, which claims priority to German (DE) patent application No. 102010031505.2, filed Jul. 19, 2010, the contents of which are incorporated by reference as if set forth in their entirety herein.

BACKGROUND

In electrical engineering, a joining process is when two components are mechanically joined together by plastic deformation, or other methods. Such mechanical joining methods are also known as crimping and provide an alternative to traditional methods, such as soldering or welding.

Crimping is used for the creation of a homogeneous, hard detachable connections between conductor and connector, which facilitates electrical and mechanical safety. The connecting element is often a corresponding connector with crimp. Wherever the laying of a finished cable with connectors is not possible, the cable is routed to the destination alone and mounted to an electrical contact portion (for example, by crimping a connector) at the end of the line.

Using a crimping tool (or crimp) the connector and cable are positively connected. This usually has a toggle, since hand strength is too weak for a permanent deformation process of the crimp barrel. Crimping connections is common in the area of radio frequency (RF) electronics and telecommunications, as crimping the connection facilitates security and the handling with it. This operation is performed by using a crimping tool. The tool and the pressing force of the crimping tool can be adapted to the crimp barrel. Crimping forms a gas-tight connection by deformation of the crimp barrel, resulting in a structure which is insulated from oxygen and thus protected against corrosion.

If the crimping is performed with insufficient force, or too much force, a gas-tight connection may not be formed. In this case, oxygen can get to the individual stranded conductors. As a consequence, the contact resistance between the cable and the crimp sleeve may be increased, leading to the corrosion at the individual stranded conductors. Furthermore, there is the risk that a cable from the incompletely compressed crimp can be drawn. With excessive pressure or too small a crimp, the cross sections of massive and fine wires may be rendered inadmissible. Subsequently, the current carrying capacity of the compound is reduced due to the reduced cross section. Furthermore, an excess of the pressing force with fine wires brings a risk that individual fibers can be sheared off. Furthermore, the crimp barrel can break or crack, rendering it unusable.

Typically, the crimp is matched to crimp profiles and cross section to achieve a predetermined deformation of the sleeve and conductor. Patent DE 102008004680 A discloses crimping of fibers in a cross-sectional area of 0.08 mm. However, cross-sections can also be larger. It would therefore be desirable to provide crimp barrels that are suitable for cables with different cross-sections and can be fitted equally with the same crimping tool.

SUMMARY

The subject innovation relates to a crimp sleeve and a connecting element with such a crimp. The interaction of a relatively thick base and thinner crimp blade subject innovation for both larger, but also for smaller cross sections of cables alike, can establish a crimp between the sleeve and cable. The base section has sufficient mass to by tailored crimping a solid bottom for the connecting element with a fixed to form compound crimp cable. The base member may have, for example a thickness of 0.8 mm, which, for example, cable cross-sections between 0.35 mm and 0.75 mm can be crimped with an inventive reliable crimp. The tapering of the thickness of the first region of the crimp blade is still enough material of the lateral region crimp is present and on the other hand by the thus-adjusted. A relationship between height and width of the crimp one Leitverdichtung can be achieved. Rejuvenation as here the reduction of the thickness of Crimp wing known, which may be evenly or unevenly. Further narrowing of the second region enables the rolling.

Crimp wings in this area in the manufacture of the crimp connection, so that a reliable crimp connection with large cross-section of material is that on top of the cable and the underlying base portion (with the base part as a part thereof) presses. As an example, the thickness of the central region is between 0.4 mm and 0.5 mm. The term refers to a section in the area with a Crimp wing perpendicular to the intended direction seen cable length. The shape of the tapered portions can be seen in a lateral section here have any suitable shape. You can for example, be monotonous or be provided with an outline (not monotonic). Examples of a monotone rejuvenation would be a taper along a circular arc or a linear taper. The expert can draw in the subject innovation, other forms of rejuvenation considered.

When crimping here any form of compounds is referred to by a mechanical pressure to a one sleeve enclosed article by material deformation of the sleeve and the subject (Squeeze) a mechanically strong connects. The enclosed object when crimping cables is stripped cable to using crimp make a good electrical contact to be able to crimp. Here, the term "sleeve" is not necessarily a closed shape before preparation of the crimping, as also crimp called. For example, sleeves can before producing the crimp be open or closed tubes, in which the stripped cable is attached or inserted. Open sleeves are usually provided in a pre-bent shape (crimping), so that the crimping means easy one can be prepared correspondingly shaped tool. The crimping may have a rounded bottom V-shaped form, wherein the base part and the first areas of the base of the rounded form Crimp wing V shape. The finished crimp has a bottom and sides, which in an approximation has rectangular cross section. The side on which the contact Crimp wing crimping roll and press on the underlying cable is referred to as upper surface of the crimped connection. Corresponding to the opposite part (the base region), the crimp sleeve called bottom. The part between the lower and upper side of the above-mentioned set. Side portions as the first page represents the side of the crimp sleeve is called, which is entirely to the cable after the preparation of the crimp faces. Accordingly, the second side of the first page is the opposite side of the crimp sleeve. The second side of the side of the designated Crimp wing, which at least in the bottom region and in the lateral regions facing away from the cable to a crimp produced.

The crimp of the subject innovation may be at least in the region of the base portion and of a slightly Crimp wing deformable and electrically conductive material such as copper alloy (for example, brass, bronze, copper, nickel, steel or aluminum alloys). For example, Crimp wing have a rectangular cross-section in the direction from the base portion to the second region, so that the electric power from the cable can be transmitted over the crimp sleeve, for example to an electrical device, the crimp sleeve may be part of a connecting element, which is provided for connection to the electrical device, and/or connected to it via an electrically conductive path.

Crimping tools are commercial tools for producing a crimped connection between the sleeve and an electric cable, such as crimping tools. The term "cables" encompasses all types of electric cables with suitable cross-sections, for example, mono- or multi-wire cable or cable from a plurality of fine strands. In one embodiment, the base part in the non-curved state to a constant thickness. This thickness may be, for example 0.8 mm. The base portion may have sufficient mass to form a solid base to crimp produced for the connecting element with a fixed connection cable crimp sleeve. A constant thickness of the base part is advantageous, so that the base part as Contact area under the cable has sufficient stability for the application of pressure in the manufacture of the crimped connection. A constant thickness brings a stable the crimp.

In one embodiment, the first area in the unbent state tapers linearly. The term "linear taper" means, in the subject innovation, a decrease in the thickness of the material in the lateral section as viewed along a straight line with a specified slope. Nonlinear tapers against would. For example, arc-like tapers. Through this taper sufficient material in the subsequent to the base part region of curvature is held, so that the compressed volume of the cable in the crimp barrel has a height-width ratio, which allows a compression conductor in the cable. The first portion is then in the crimped state, at least partly as side region (where the Crimp wing not at least greatly deform) on the crimp. Thus, a gas-tight crimp with good electrical contact and conductor properties can be produced.

In an alternative embodiment, the first region at least one first sub-area adjacent to the base part and at least one second sub-range then to the central region, wherein the taper in the first and second sub-areas in the unbent condition varies. Herewith, in addition to the foregoing benefits (linear taper) an approximately circular curvature of the first side in the production of the front crimping Crimp achieved. In this near-circular curved first side the cable may fit particularly well. To the taper is in the first Sub-region than in the second sub-area because the Crimp wing be curved in the first sub-region for the production of crimping stronger than in the second sub-region. The term "more" refers to a linear taper with a larger Gradient. In this way, a nearly circular curved first side generate easily. In one embodiment, to the first sub-area adjacent to the second sub-area. In another embodiment, to the taper in the first and second sub-areas is formed linearly with a different pitch. Both embodiments can also be combined. Would the tapers in the second sub-area to be stronger than in the first sub-region, a circular first page in the V-shaped crimping would hardly produce and the support for the einzucrimpende cable would be less favorable to that there was a slippage of the cable more leeway. The taper between base and mid range should be as steep as possible so that the crimped state Crimp wing are as long as possible. Thus an ideal Crimpverhalten supported.

In another embodiment, the lateral extent of the base part and the Crimp wing is adapted so that a bottom part in the crimped state of the base part and the first sub-areas exists. Thus, with normal material thickness in the base portion and the taper in the first sub-area and cable with very small cross-sections are crimped reliable. The term "lateral extent" refers to the extension in the direction which is perpendicular to the intended direction of the cable into the crimp barrel. This is a good stability of the crimping reached.

The taper of the second portions may for example be provided with a contour or monotone (non-monotonic) bear. An example of a monotonic taper would be a taper along a circular arc. The expert can draw in the subject innovation, other forms of rejuvenation considered. In one embodiment, the second regions of the non-curved state Crimp wing taper linearly. For example, the second portion is tapered relative to a pitch of about 20° to the second side in the middle. The front sides of the second portion of the state are at the unbent Crimp wing perpendicular to second side of the first and second regions, as well as the base part. This linear taper of the second region on the side of the second side leads during crimping (manufacture of the crimp) to a curling Crimp wing in form of a screw, which presses as a common wide area on the cable. This prevents that the second regions of Crimp wing remain during crimping are as sharp fronts and so passing through the cable press and optionally one or more shear cable wires. By the rolling of the second regions to a fixed worm reliable crimp connection is made with the cable.

In a further embodiment, the strength of the linear tapers of the second regions is adapted such that the second sides of the second regions with a crimp sleeve in an open V-crimping shape is substantially parallel to each other. Characterized the introduction is facilitated in the Quetschform the crimping tool, resulting in a good crimping. The term "substantially" includes all crimp forms which differ by a few degrees from an exact parallelism of Crimp wing in the second regions.

In one embodiment, the central portion tapers in the non-curved state along the first side to the second region. Here Crimp wingdicke is defined so that the ratio of material thickness to a cross-sectional shape Standardcrimphülse resembles. Of the first region facing the part of the central region may In one embodiment, the central portion tapers in the non-curved state along the first side to the, for example a thickness of 0.5 mm, which tapers towards the second region, for example, go to 0.4 mm. This taper may be linear. In one embodiment, the taper of the intermediate portion of the first side extends equally also extends over the second region. Thus, the rolling of the second regions is further supported during crimping.

In another embodiment, the second side of the second region outside Crimp wing and the underside of the base part form the unbent state, a planar surface. This production, it is (for example a punching process) in the production of Crimp wing beneficial. Since the deformations can be produced easily from above, it is advantageous if the bottom flat (plan) remains.

The subject innovation further relates to a connecting element according to the subject innovation crimping sleeve. Such a connection element may further comprise at least one insulation crimp for holding a cable (with or without isolation) and a functional part in electrical contact with the crimp barrel. The insulation crimp protects the crimped connection between cable and crimp from mechanical influences such as bending-bending and tensile stress and vibrations acting all in good crimp only to the insulation crimp. The Insulation crimp can be manufactured from any material which is a sufficiently good crimp sufficiently mechanically deformable. The insulation sleeve may be made of the same material as the insulation crimp. In one embodiment, the entire connection member is made of the same electrically conductive material, such as brass, bronze, copper, nickel silver or steel. Electrically conductive material is useful as the functional part is a connector. This is a good connection with the functional part is possible.

BRIEF DESCRIPTION OF THE DRAWINGS

These and other aspects of the subject innovation are shown in detail in the figures as follows.

DETAILED DESCRIPTION OF SPECIFIC EMBODIMENTS

Figure 1:
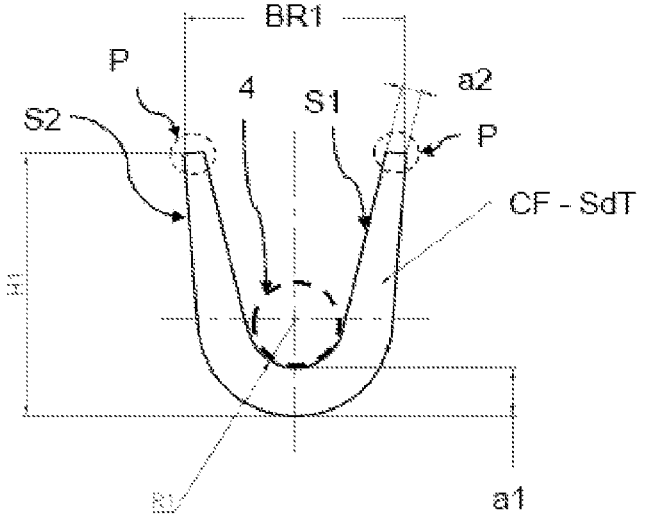
FIG. 1 is a crimp according to the prior art in the form of pre-bent (Crimpform).

FIG. 1 shows a crimp barrel (CF SdT) in pre-bent shape in side view (section perpendicular to the direction in the subsequent cable crimp) according to the prior art. The pre-bent shape (crimping CF) has the shape of a "V" with a curved base and upwardly facing Crimp wingn that hold each other a maximum distance BR1, the width of the crimping CF. The radius of curvature R1 of the curved base is dimensioned such that a cable 4 are placed with a certain cross-section in the curved base can. Thus, a suitable radius of curvature for the cable 4 can be achieved R1, the base may have a thickness a1. The crimp sleeve has a first side S1, produced in the Crimp is facing the cable and a second side S2, which is the opposite side of the crimp sleeve to S1. The tips of the Crimp wing P have a thickness less than the thickness a1 a2, so that the roll can Crimp wing during crimping.

Figure 2:
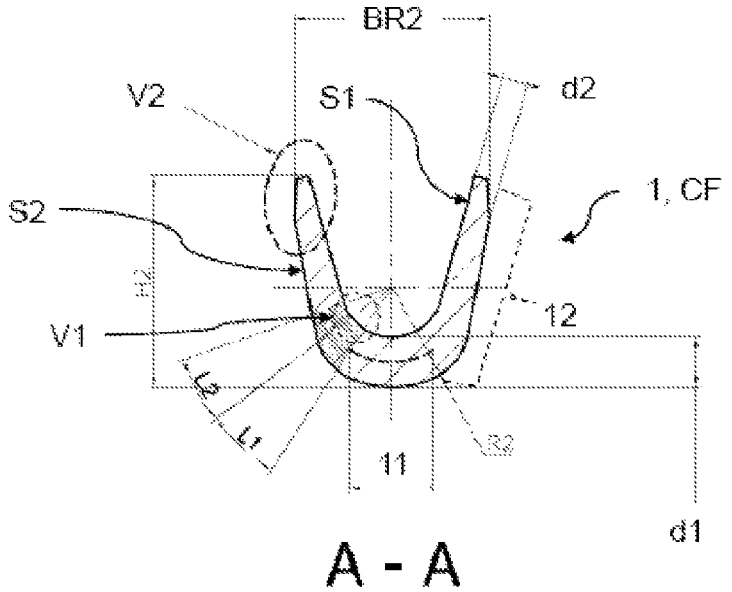
FIG. 2 is a crimp according to the subject innovation in the form of pre-bent (Crimpform).
Figure 5:
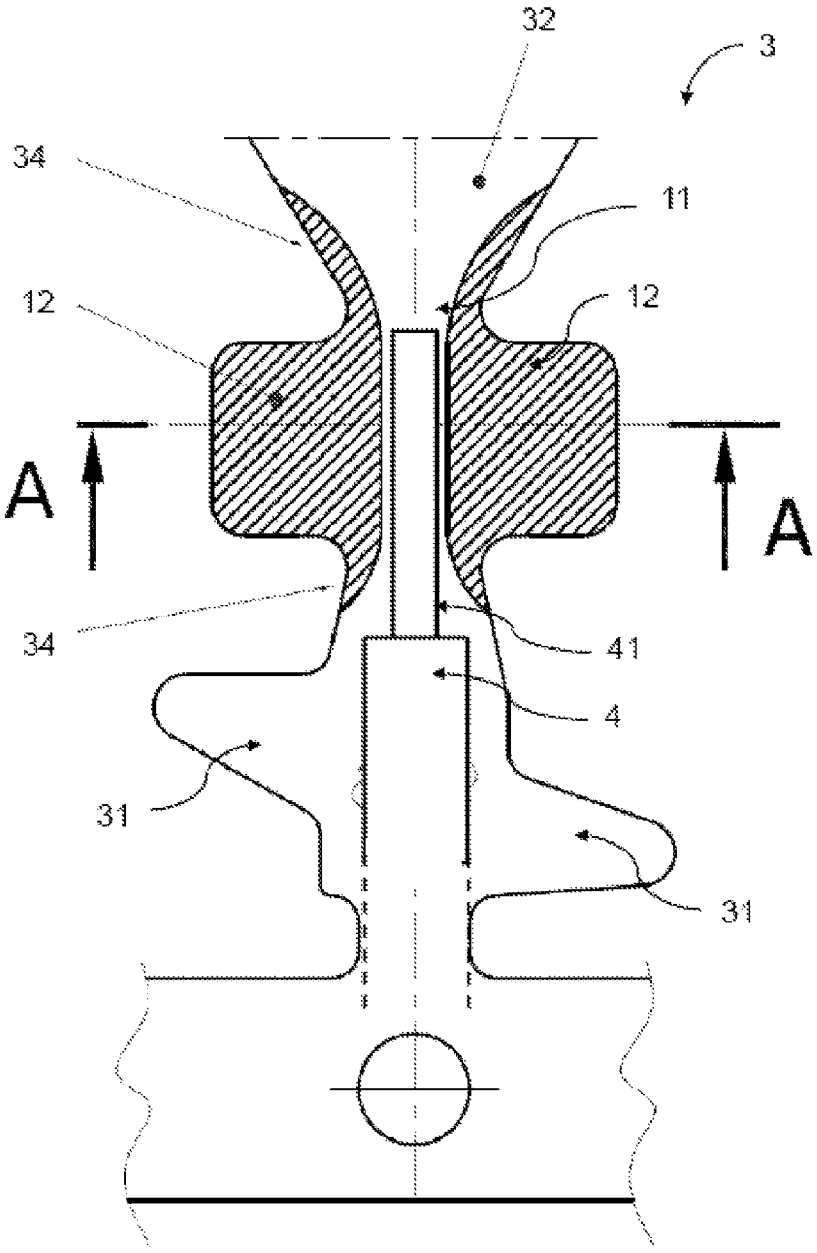
FIG. 5 is an embodiment of a connector according to the subject innovation.

FIG. 2 shows a crimp 1 in pre-curved shape (crimping CF) as a section along the direction of AA, see also FIG. 5 The prebent crimping CF also has the shape of a "V" with a curved base 1 1 and upwardly pointing Crimp wingn 12 that hold each other a maximum distance BR2, the width of the crimping CF. The radius of curvature R2 of the curved base is dimensioned so that a cables (here for the sake of clarity, not shown) with a certain cross-section in the curved base can be placed. Thus a suitable for the cable 4 the radius of curvature R2 can be attained, the base having a thickness d1, closes on the base part 1 1 of the first portion of the Crimp wing 12 to which is (shown hatched in the left Crimp wing) as shown in two sub-regions L1 and L2 are subdivided. In alternative embodiments could be, instead of the sub-regions L1 and L2 of the first region is performed without subdivision into sub-regions. The Crimp wing 12 taper V1 significantly in the sub-ranges L1 and L2, so that a suitable radius of curvature for the respective cables with different cross sections can be produced. The crimp sleeve 1 has a first side S 1, which is in the produced crimp the cable faces and a second side S2, which is the opposite to S1 side of the crimp sleeve first, the middle area of the Crimp wing 12 has a thickness d2 of the smaller the thickness d1, which tapers in the second region of Crimp wing further V2, so that the Crimp wing 12 during crimping also Cable can roll suitable with small cross sections.

Figure 3:
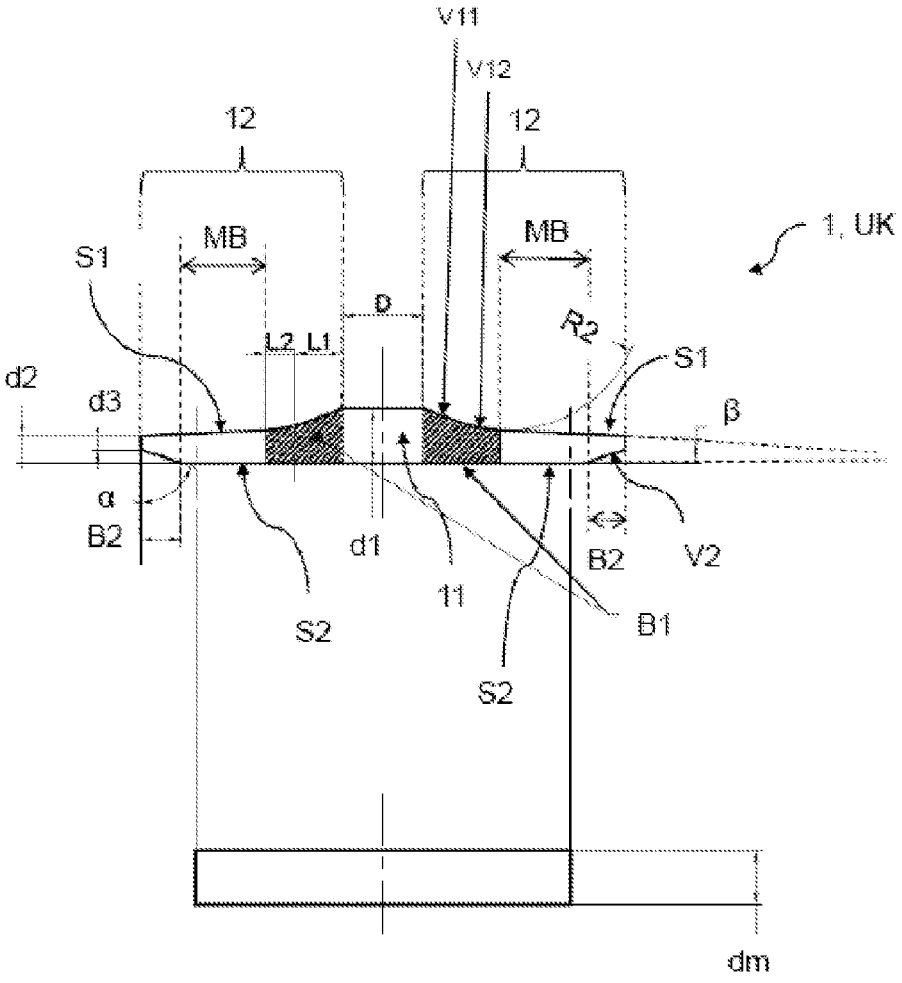
FIG. 3 is a crimp according to the subject innovation in ungekrümmter form.
Figure 4:
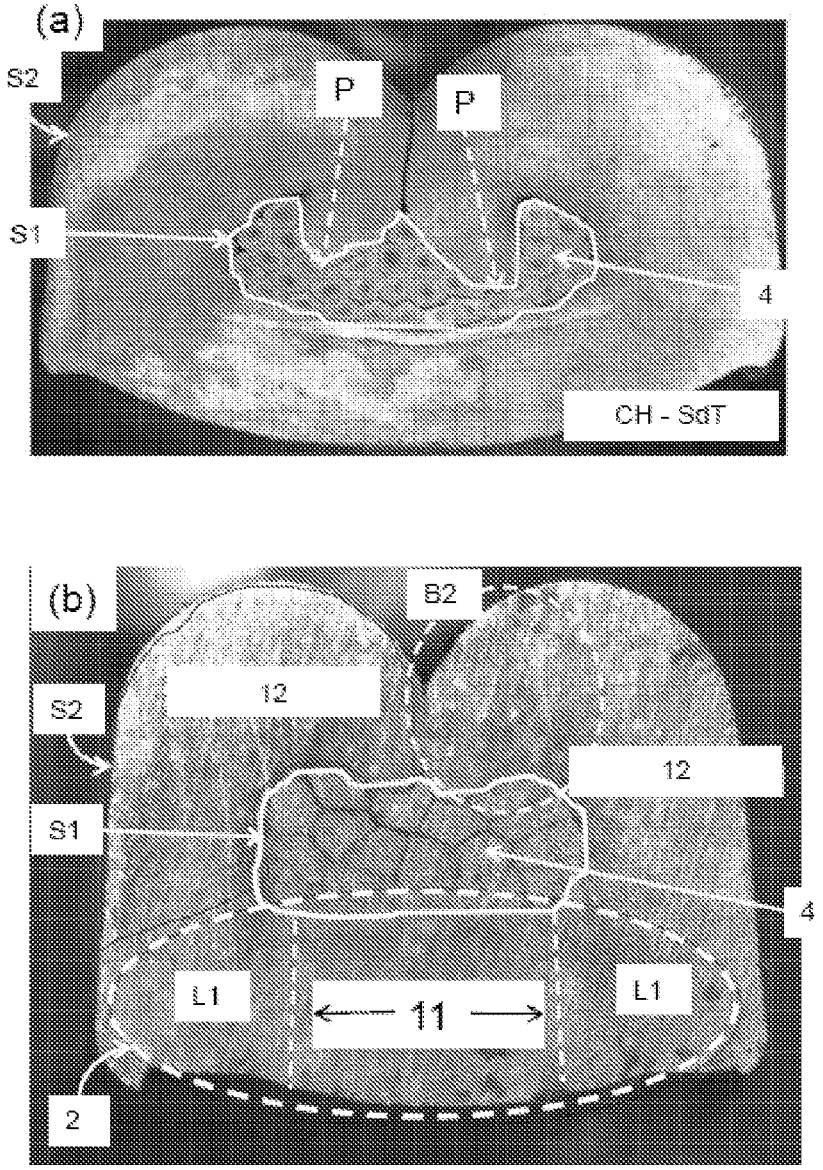
FIG. 4 is a crimped connection between the sleeve and cable (a) according to the prior art, and (b) according to the subject innovation

FIG. 3 shows a crimp in ungekrümmter form UK as a section along the direction of AA, (see also FIG. 5). The base part 1 is one of a thickness d1 (for example 0.8 mm) and a lateral dimension D (perpendicular to the direction in the subsequent cable crimp) the central region of the first crimp ferrule Close to the base part, in this embodiment on both sides of a respective first 12 Crimp wing area B1, at a central portion and a second portion B2 MB. The Crimp wing 12 are the first areas to the base part B1 1 1 (see FIG. 5), the full length of 12 Crimp wing connected. To in the later crimped to establish a crimp connection to a cable in a suitable form can, which ensures a secure fit of the cable, and the risk avoided, thereby to cut through the cable, the thickness of the Crimp wing 12 in the first range B1 narrows significantly, the two sub-areas L1, L2 includes (hatched). Here the rejuvenation V1 1 in the first sub-region L1 is stronger (greater reduction in thickness) than the taper V 12 in the second sub-region L2. To the first range B1 then closes the central region at the MB Crimp wing 12, for example having a thickness of 0.5 mm at the edge of the first region B2 In this central region, the MB Crimp wing rejuvenate 12 next, though not as strong as in the first region B 1. Extended If we consider the first side S1 along the surface of the central portion MB, so there is a taper angle β with mentally elongated side S2, which is in the base portion 1 1, the first region and the central region BM plan (see dashed lines). The second portion B2 having a first side S1, which in accordance with the uniform surface of the central portion MB, that extends with the same taper angle, and along the second portion B2. The other opposite side S2 of the second portion B2 V2 tapered significantly towards the tip of the Crimp wing 12$^{th}$. The second area B2 has at the border to the central area has a thickness d2 MB (for example, 0.4 mm), which is significantly greater than the thickness d3 (eg, 0, 15 mm) of the second portion B2 on its tip. The taper in this example, V2 is designed so that the second side S2 in the region of the second region forms an angle B2 to the end face of the second portion B2 of about 70°. This corresponds to an angle of approximately 20° between the second sides of the central region S2 MB and in the second area B2. FIG. 3 further shows a section from the middle section parallel to the base MB 1 1. The central region has MB along this section, a rectangular shape with a thickness dm, which depends on the location of the cut. The closer the average is the second region B2, the smaller dm. Right on the border for the second range B2 dm=d2. For example, d2=0.4 mm FIG. 4 shows the preparation of a crimp with cables according to a respective crimping tool for crimping crimp sleeves (a) according to the prior art, and (b) according to the subject innovation. FIGS. 4 (*a*) and 4 (*b*) are not shown to scale to each other, so that proportions of a figure cannot be directly transferred to the other figure.

FIG. 4*a* shows that according to the prior art crimping sleeves for cables 4 with small cross-sections, so roll up, that the tips of the barrel contacts P significantly in the cable 4 pierce and, if appropriate, can also cut through the cable. On one hand, this leads to a non-secure seat crimp on the cable, on the other hand, the conductivity of the cable will be negatively affected. Too low cross-sections in the crimped state may lead to a reduced conductivity in this area. In addition, the exclusion of air could no longer at such a link to be ensured so that corrosion of the crimp may arise over time.

FIG. 4*b* shows the other hand, an ideal form of a crimp connection with a crimp of the subject innovation, wherein the cable has a crimped cross-section deviating from the ideal of smaller cross-section. The bottom part 2 comprises the base 1 1 (with 0.8 mm thickness) and the first sub-regions of the two L1 Crimp wing 12. The lateral parts of the crimp are at the outer regions of the bottom part 2 at the top of the crimp Crimp wing 12 roll easily by their invention designed tapering in their second portions B2, but without (shown in contrast to the prior art shown in FIG. 4*a*) with sharp edges in the cable 4 hereinzustechen. The pinched cable 4 original cross-section 0.5 mm 2 here has a rectangular cross section with good holding and conducting properties. This shape of the side S1 of the cable or to the preparation of the crimp connection is only possible with a crimp sleeve in accordance with the present invention over a wide range of cable diameters.

FIG. 5 shows a link 3 with a crimp 1 in plain view (view from the top of FIG. 2). Section AA in which the images were displayed 2 and 3, here represented by the line with marks "A". The crimp sleeve has a base part 1 1 between the Crimp wing 12$^{th}$. The crimp sleeve in this embodiment is part of the connecting element 3, which also has two 31 includes insulation crimp to hold the cable in the region with an intact cable insulation. The insulation crimp 31 designed to keep mechanical loading of the cable 4 from the crimp to the stripped cable 41. The connecting element 3 further comprises a functional part 32, with crimp in the electrical contact. This functional part 32 can be for example a plug for connecting to an electrical device. The Crimp wing 12 are compared with the base part 1 1 tapers in their thickness, which is shown in FIG. 5 as a hatched area. This narrowing can be for better production of a crimp connection or in the direction of the insulation crimp 31 and the functional part 32 extend (see area 34) in order not to expose these parts too large tensions on the production of the crimped connection. The crimp sleeve and the entire connecting element may be made of the same electrically conductive material, for example copper alloys (brass, bronze, copper, nickel, etc.), steel or aluminum alloy, may be made.

The embodiments shown here represent only examples of the subject innovation and are therefore not to be understood as limiting.

What is claimed is:

1. A crimp barrel comprising a base part and at least two deformable crimp wings for producing a crimp connection with a cable, wherein the Crimp wing respectively connects a first portion with a base including a second portion and a central portion arranged between the first portion and the second portion, and wherein the base has a thickness greater than a thickness of the central portion, wherein the Crimp wing comprises a first area tapered from the base part for the central portion down at least on a first side, and a second area extending from the central portion, starting at least one of the first side opposite to the second side is further tapered, wherein the base part in an unbent state has a constant thickness and wherein the first portion in the unbent state is linearly tapered and the first area comprises at least one first sub-portion adjacent to the base part and at least one second sub-portion adjacent to the central portion, wherein a taper varies in the first sub-portion and the second sub-portion, in the unbent state.

2. The crimp barrel of claim 1, wherein the first sub-area is disposed adjacent to the second sub-area.

3. The crimp barrel of claim 2, wherein a plurality of constrictions tapered linearly in the first sub-portion and second sub-portion each comprise a different pitch.

4. The crimp barrel of claim 3, wherein a lateral extent of the base and the crimp wing is adjusted so that a bottom part is in a crimped state of the base part and the first sub-areas.

5. The crimp barrel of claim 1, wherein the second portion of the crimp wing in the unbent condition is linearly tapered.

6. The crimp barrel of claim 1, wherein an angle of linear tapers of the second portion is adapted so that the second side of the second portion in the crimp barrel in crimping in an open V-crimping shape are substantially parallel to each other.

7. The crimp barrel of claim 1, wherein the central portion tapers in an unbent state along a first side to the second portion.

8. The crimp barrel of claim 1, wherein a taper of the middle portion of a first side extends equally on the second portion.

9. The crimp barrel of claim 1, wherein a second side of the crimp wing form outside the second portion and an underside of the base in an unbent state comprises a flat surface.

10. The crimp barrel of claim 1 comprising a connecting element with the crimp barrel.

11. The crimp barrel of claim 10, wherein the connecting element comprises at least one insulation crimp for mounting of an isolated portion of a cable and a functional part in electrical contact with the crimp barrel covers.

12. The crimp barrel of claim 11, wherein the functional part comprises a plug.

* * * * *